United States Patent [19]

Mork

[11] Patent Number: 4,746,245

[45] Date of Patent: May 24, 1988

[54] OFFSHORE DRILLING AND/OR PRODUCTION SYSTEM

[75] Inventor: Harald J. Mork, Sandnes, Norway

[73] Assignee: Den norske stats oljeselskap a.s., Norway

[21] Appl. No.: 834,798

[22] Filed: Feb. 28, 1986

[30] Foreign Application Priority Data

Mar. 1, 1985 [NO] Norway ..... 850836

[51] Int. Cl.[4] ..... E02B 17/00

[52] U.S. Cl. ..... 405/224; 405/195; 405/204

[58] Field of Search ..... 405/195, 204, 207, 217, 405/224, 227; 175/5, 9

[56] References Cited

U.S. PATENT DOCUMENTS

| | | | |
|---|---|---|---|
| 2,939,290 | 6/1960 | Crake . | |
| 3,522,709 | 8/1970 | Vilain . | |
| 3,526,096 | 9/1970 | Frein et al. . | |
| 4,045,967 | 9/1977 | Schirtzinger . | |
| 4,181,453 | 1/1980 | Vache . | |
| 4,310,052 | 1/1982 | Rivertz . | |
| 4,422,803 | 12/1983 | Wetmore | 405/204 |
| 4,425,055 | 1/1984 | Tiedemann | 405/207 X |
| 4,474,508 | 10/1984 | Vos et al. | 405/195 |
| 4,492,270 | 1/1985 | Horton | 405/227 X |
| 4,575,281 | 3/1986 | Oksuzler | 405/217 |

FOREIGN PATENT DOCUMENTS

| | | |
|---|---|---|
| 0039590 | 11/1981 | European Pat. Off. . |
| 772388 | 7/1977 | Norway . |
| 783914 | 11/1978 | Norway . |
| 1098211 | 1/1968 | United Kingdom . |
| 1244273 | 8/1971 | United Kingdom . |
| 1421764 | 1/1976 | United Kingdom . |
| 1436291 | 5/1976 | United Kingdom . |
| 1457170 | 12/1976 | United Kingdom . |
| 1477461 | 6/1977 | United Kingdom . |
| 1512025 | 5/1978 | United Kingdom . |
| 1512636 | 6/1978 | United Kingdom . |
| 1523096 | 8/1978 | United Kingdom . |
| 2017786 | 1/1979 | United Kingdom . |
| 1545138 | 5/1979 | United Kingdom . |
| 2114188 | 8/1983 | United Kingdom . |
| 2116615 | 9/1983 | United Kingdom . |
| 2138472 | 10/1984 | United Kingdom . |

*Primary Examiner*—David H. Corbin

*Attorney, Agent, or Firm*—Lucas & Just

[57] ABSTRACT

System for development and exploitation of oil and or gas fields offshore, including drilling and the employment of a gravity platform (6). An elevated foundation (2) is established on the seabed (1) for placing of a predrilling template (7) on top (3) of the foundation, preferably a rock-fill foundation. One or several wells is predrilled from at least one cavity of the predrilling template (7), after which a gravity platform is placed on the foundation (2), at least one of the shaft of which platform being downwardly open and arranged for cooperation with the predrilling template (7). After installation of the platform drilling-, production- and living quarter modules (16, 17, 18) are placed on the platform deck (15). Water is pumped out of the shaft (11) and the cavity in the predrilling template (7), in this way providing a dry 1-atmospheric chamber at the base of the platform where operations like connecting wells to conductor pipes etc. may take place.

18 Claims, 5 Drawing Sheets

OFFSHORE DRILLING AND/OR PRODUCTION SYSTEM

Figure 1:
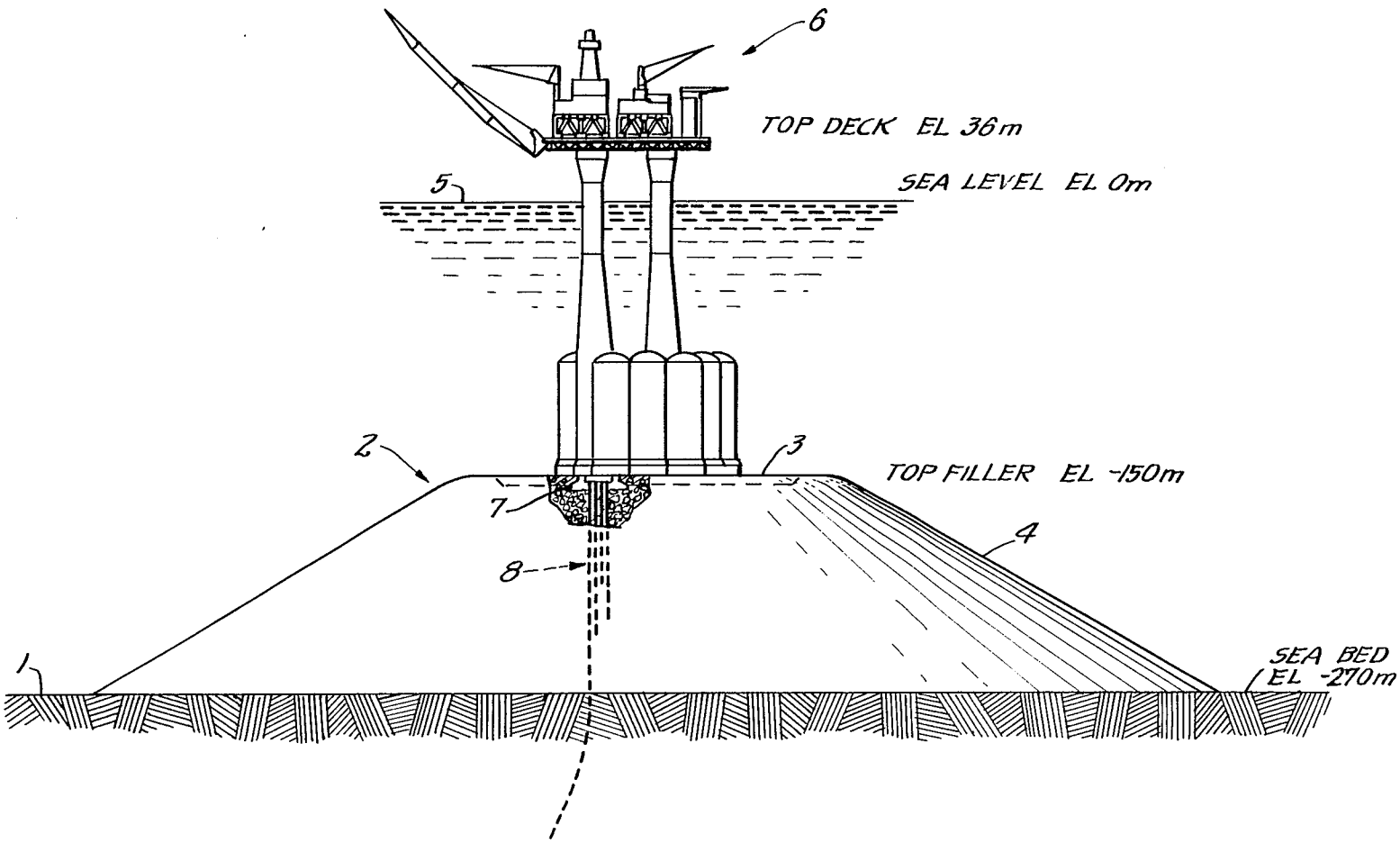

Oil and gas production offshore demands very high investments. The question of developing a given field is to a high degree depends on necessary investment, especially in drilling/production production platforms. In this connection the time aspect is also of very considerable importance. If the time needed for construction and the time schedule for the completion of the various elements of such a construction project can be reduced this will have evident economic advantages. Another important aspect is the safety of personnel and equipment. In addition one also has the problems of transport of personnel to and from the platforms, including the evacuations in emergency situations.

The present invention is aiming at improving different aspects of the complete system for developing oil and gas fields as well as parts of such a system. In short the invention is based upon a total concept which comprises making a fill for a basement on the seabed, placement of a so called pre-drilling template on the basement, predrilling of one or several wells, placing of a gravity platform of a special design on the basement where upon modules for drilling, production and lodging of personnel are placed on the platform deck, draining of water from one of the platform shafts and tie-in of tubes, etc. from the shafts to one or several wells drilled from the predrilling template, after which the necessary operations for production of oil and/or gas may be carried out through a desired period of time. When the production is at an end, the tubes are disconnected, etc. from the wells, drilling-, production- and living quarters modules are removed from the platform deck, and the necessary buoyancy for the platform is established by draining out water, after which the whole platform is removed from the basement. The platform and said modules may so be transported for reuse on another site.

A very important component in said system or concept is a specially designed template made of concrete, the so called predrilling template, which is placed on the fill and arranged to cooperate with the base of one of the platform shafts. This shaft is downwardly open, giving in this way admittance through the shaft to an upwardly space on the predrilling template, making it possible, after drainage of water, for personnel to carry out operations on components and installations at the wellheads which are mounted in the cavity of the predrilling template.

The new and the characteristic features of the different aspects of the invention are stated in the claims.

In short it is an object of the present invention to level out the activity in the various phases of the project and later on to ensure a smooth production profile of the oil and/or gas exploitation. This will result in a reduction in investments and a shortened time schedule for the whole project. It is further an object of the invention to make improvements in the optimal use of resources and to ensure enlarged production at lower operating costs compared to conventional technique. These advantages are linked to an up to now unknown standardization in large scale of the main components in the system, including the platform itself, which is based upon a standard depth, the same seabed condition or flowtation etc., which contributes to reduce the construction and engineering as well as the building cost. Clearly this is also linked to the fact that the main components as the platform itself, the drilling-, production- and living quarter modules may be reused by moving from field to field. When the production is finished in one field, it is easy to remove the platform in such a way as to virtually eliminate the costs relating to the removal of conventional installations. Further, when leaving a field it is important not to leave any remnants, for instance pieces of wreckage after blasting, on the seabed. The fill that will remain will not represent any hindrance for fishing or shipping industry and if necessary, the cavity in the predrilling template may be closed with a suitable lid. This will ensure amongst other things that for instance fishing by trawling along the seabed may take place without hindrance after the oil and/or gas exploitation is finished.

Figure 3:
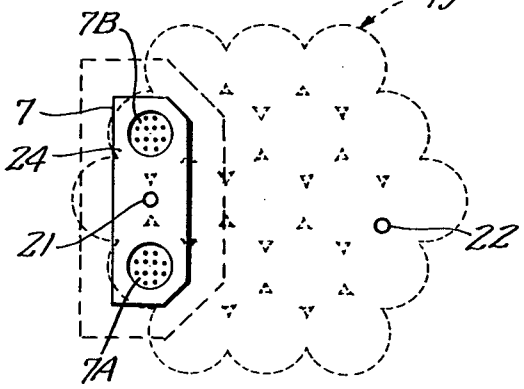
Figure 2:
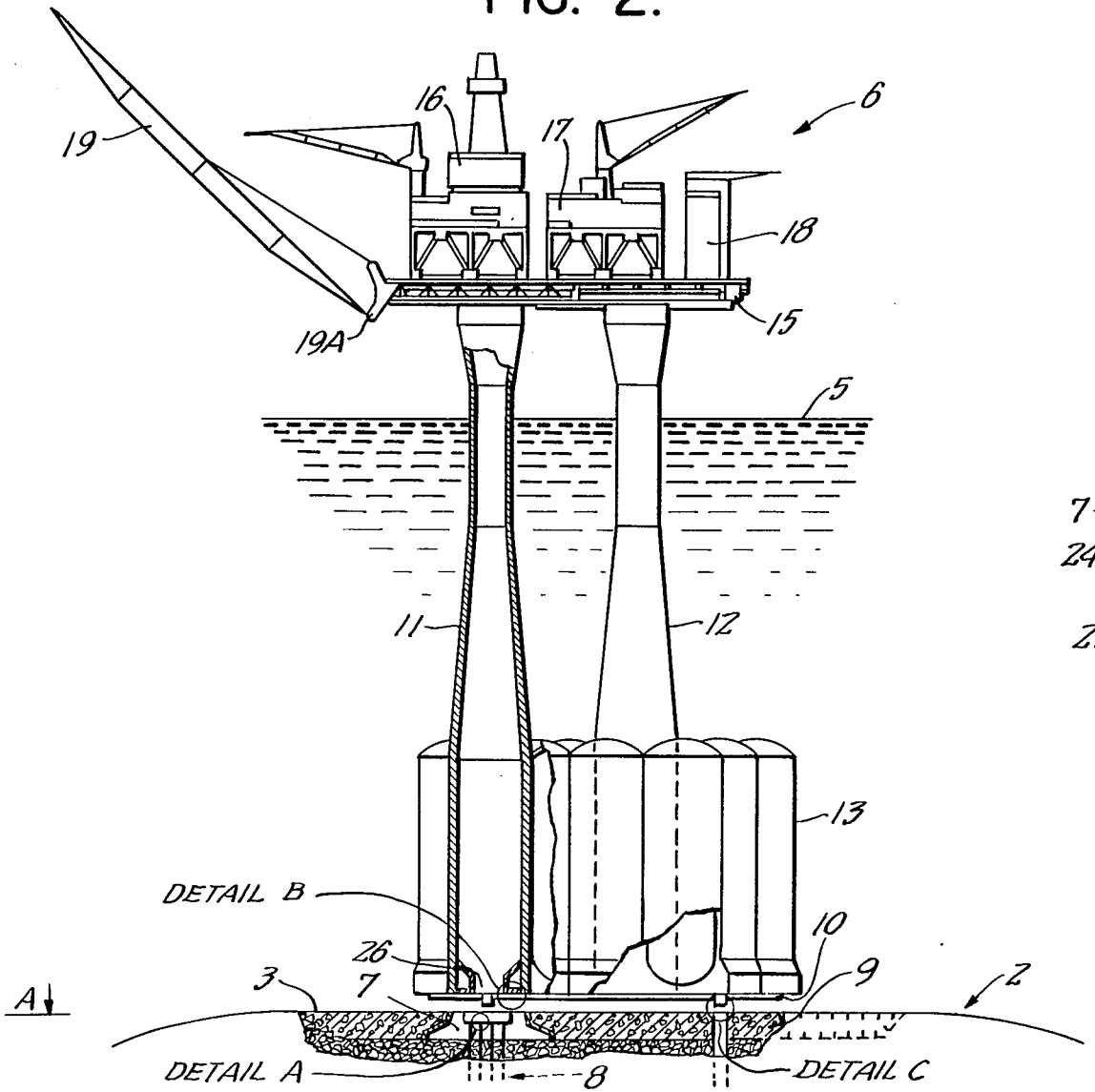
Figure 3B:
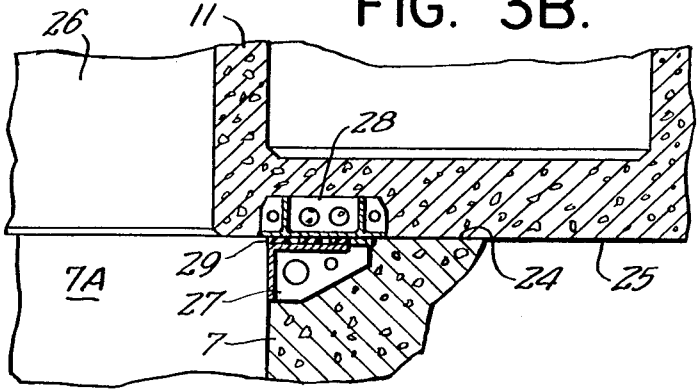
Figure 3C:
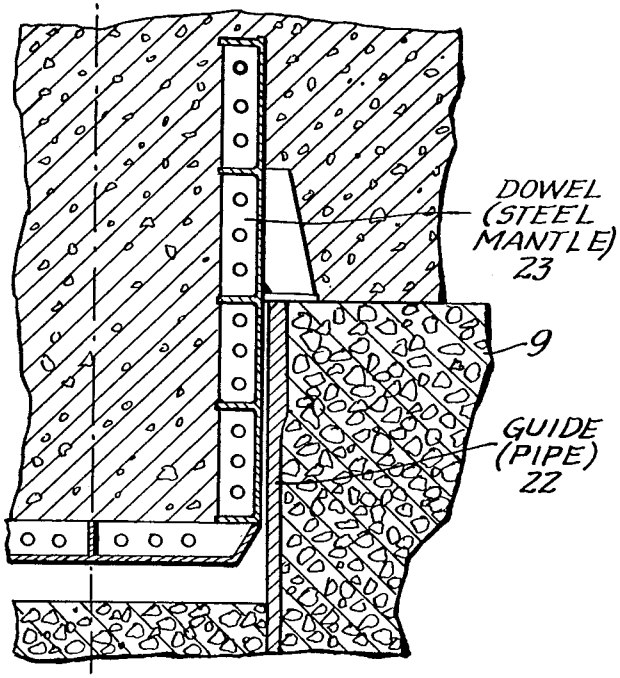
Figure 3A:
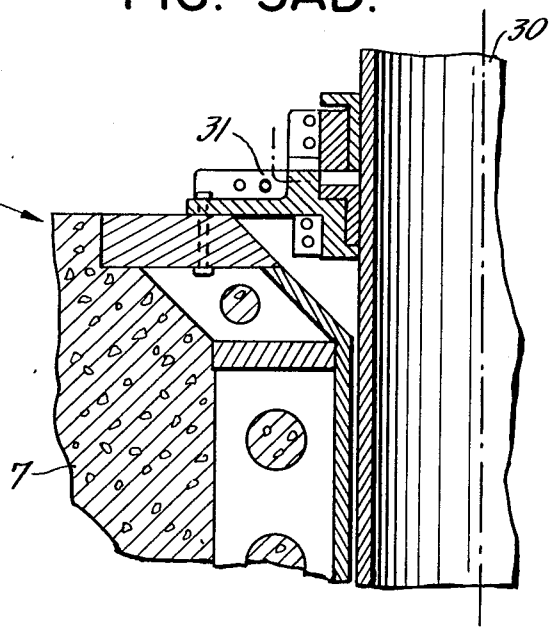
Figure 3A:
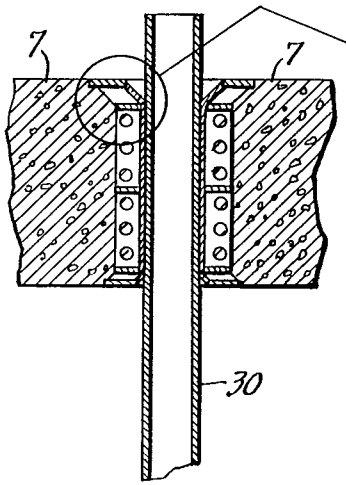
Figure 4:
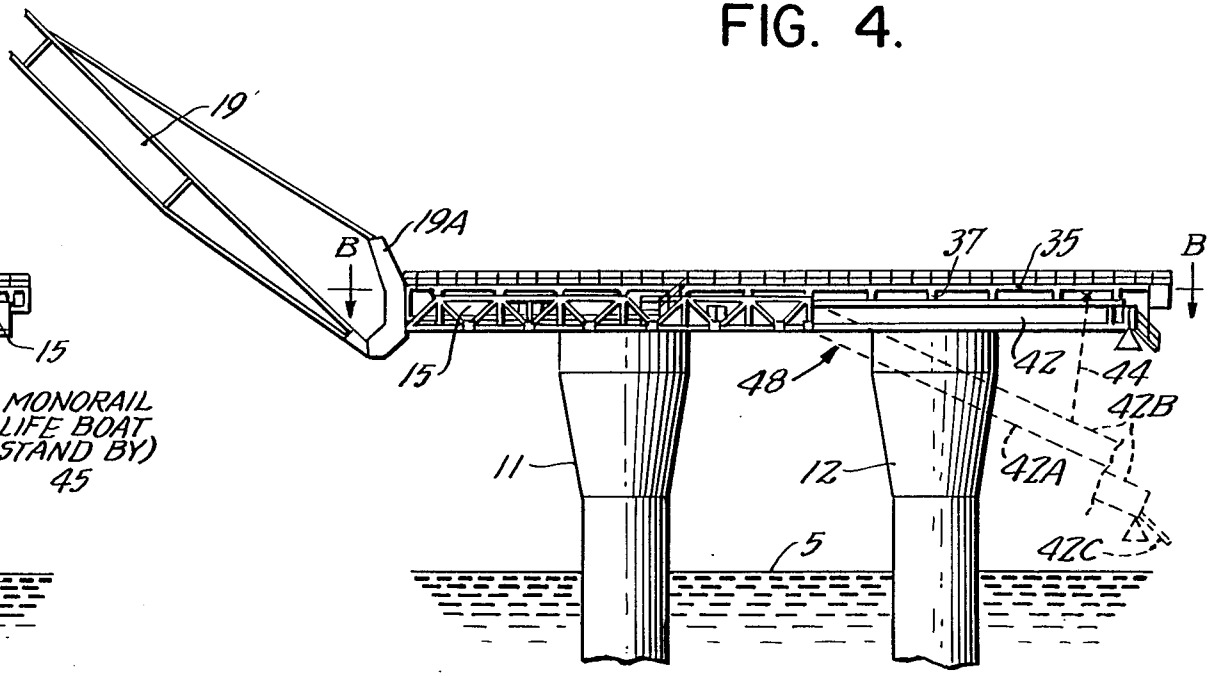
Figure 5:
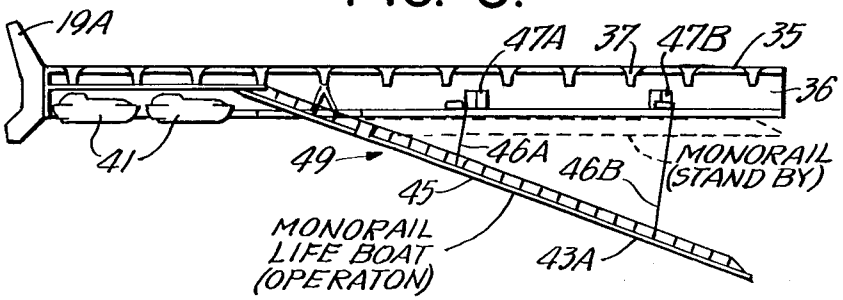
Figure 6:
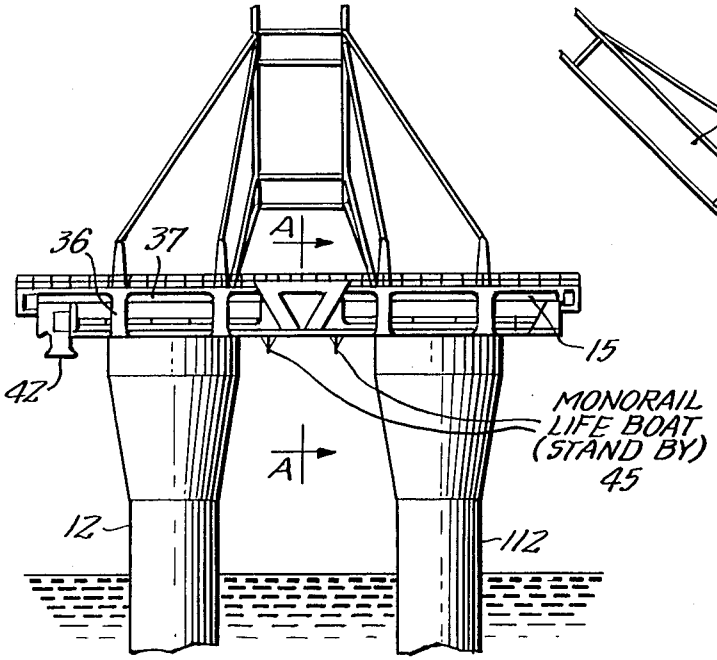
Figure 7:
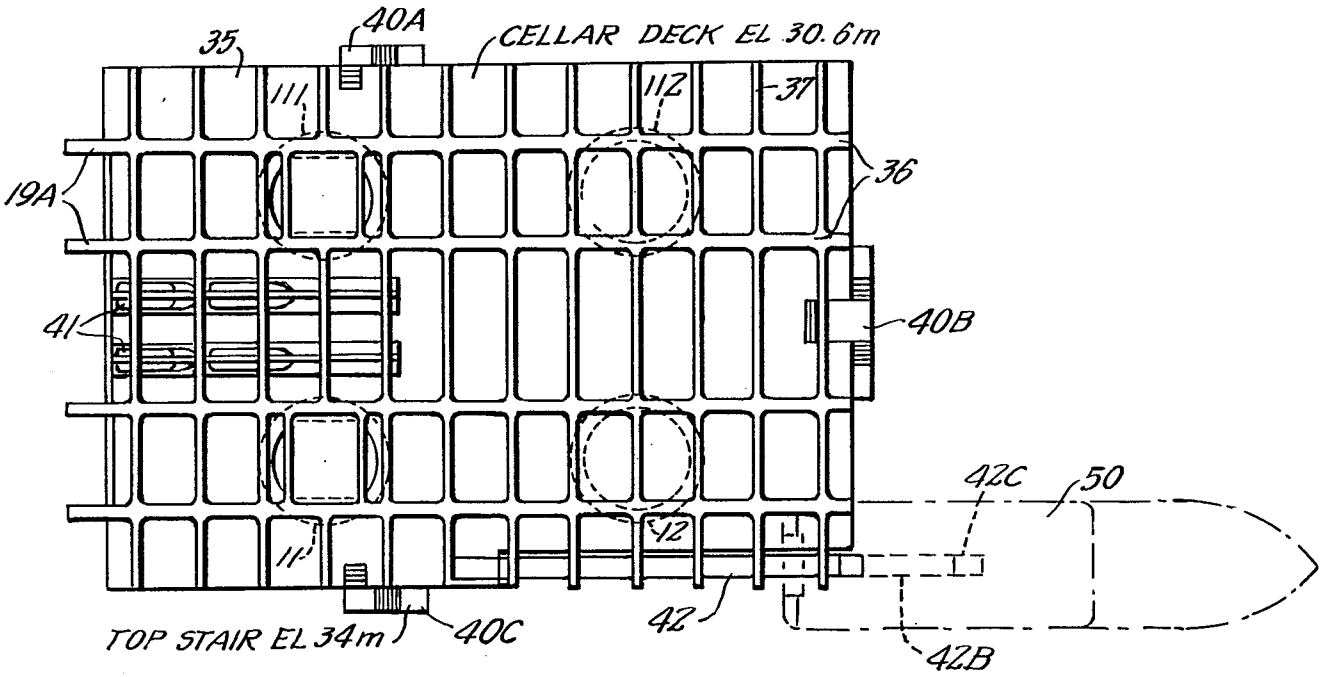

The invention will be more closely explained by referring to the drawing, where:

FIG. 1 shows a diagrammatic view of a platform offshore placed on a foundation, FIG. 2 shows the platform according to FIG. 1 partly enlarged and in somewhat more detail, FIG. 3 shows schematically a plain view of the base of the platform. form and a predrilling template placed on the foundation ("a—in FIG. 2"), FIG. 3A shows in section a detail of a guiding device on the predrilling template ("detail A in FIG. 2"), FIG. 3AD shows in enlargement and in cross section a drawing between the guiding device and the predrilling template according to FIG. 3A, FIG. 3B shows in cross section in the vertical plan details of the sealing device between the platform and the predrilling template ("detail B in FIG. 2"), FIG. 3C shows in cross section in the vertical plans details of a dowed for accurate positioning of the platform in relation to the predrilling template ("details C in FIG. 2"), FIG. 4 shows a side view of the platform deck with an evacuation device in stand by position, and in operating position respectively, FIG. 5 shows a somewhat simplified view of the same deck as in FIG. 4, but with another evacuation device, also in stand by position and in operating position, respectively ("a—a in FIG. 6"), FIG. 6 shows an end view of the platform according to FIG. 4 and 5, FIG. 7 shows a view of the platform according to FIG. 4–6, seen from above and somewhat schematically ("b—b in FIG. 4").

The main features of the basic system of the total concept according to the invention is illustrated on FIG. 1.

A fill 2 is established on the seabed 1 as a foundation for a gravity platform 6. The sea level is indicated by 5. The platform 6 is here shown as a concrete platform, but it is evident that the essential features of the invention also applies to suitably constructed steel platforms. The fill 2 has relatively slanting sides 4, for instance with an inclination of 1:3, so that when the platform is removed, trawling can take place over the remaining fill without problems. The fill is established on the seabed to a height that is considered optimal, for instance to a level of 150 m below the sea level 5. This will be a suitable height of the fill when the total depth of water amounts to for intance 270 m. The top 3 of the fill can then be used as a foundation for a gravity platform 6 of reasonable dimensions. Further details on laying a basement on the top level 3 are indicated in FIG. 2. FIG. 1 however, shows a specially designed concrete template, namely the so called predrilling template 7, which is included in the foundation or the top level 3 for cooperation with the base of the platform 6 itself, more precisely with one of the shafts of this platform. A number of wells 8 are shown to have been drilled from the predrilling template 7 to various depth partly in the fill 2 and partly further down below the seabed 1.

An optimum number of wells 8 are preferably predrilled from the predrilling template by means of for instance a jack-up platform or a semi submersible platform, that is to say a non-permanent platform or a drilling vessel which is later removed. These predrilled wells are completed and provisions for sealing between the concrete floor in the predrilling template 7 and the conductor pipes running through it, are then made. These details will be further explained below.

The concrete structure which comprises the platform 6, may according to the principle illustrated in FIG. 1, be of a standard type, that is to say intended for one and the same depth of water with the same conditions at the bottom, etc. As will be explained in the following, the platform needs only to be supplied with a floating capacity for its own weight including the concrete and the lifeboats together with flarebooms, etc., since modules for drilling, production and lodging of personnel are to be lifted on to the platform deck after the submerging of the platform on the foundation 2, whereby the platform 6 can be constructed for a load of for instance as little as 15000 tons. The design criteria for the platform will be the stability in the operational state, i.e. the floating ability of the deck and the stability during towing from land out to the field. It is evident that under these conditions the platform structure itself may be made minimal and thereby cost-saving to the highest degree.

After the desired time of use, i.e. as long as economic production from the field can be carried out, for instance from 10 to 15 years, the platform 6 may be raised from the foundation 2 and moved to another site. When this happens, the necessary disconnections are carried out in the predrilling template 7 and the main modules on the platform deck, namely the drilling module, the production module and the living quarter module, are lifted off. Water is removed from the concrete cells in the lower part of the platform until necessary buoyancy is established and the whole concrete structure which compromises the platform 6, may be towed away. In the mean time preliminary operations have been carried out on a new location, possibly on a new field where wells are predrilled from a predrilling template placed on a foundation as illustrated in FIG. 1, and the platform may be placed on this location after a shorter or longer towing distance, and eventually the said modules may be lifted on board the platform deck. Thereby the same main components and modules, possibly after necessary adjustments, are ready for operation on the new site, which evidently leads to considerably reduced investments in total.

Finally in the connection with the field described above, it can be mentioned that procurement of the necessary material for this, may be combined with useful and desired plants on land, for instance by development of storing facilities for oil etc., in rock. By useful combination of the production of filling material and suitable facilities on shore, filling material of necessary quality can be provided for in a very economic way.

FIG. 2 shows several details of the arrangement in FIG. 1. Only the upper part of the fill 2 with the top part of the fill 3 and the special structures compromising the foundation of this, is shown in FIG. 2. In the mainly horizontal top part 3 of the field a predrilling template 7 is installed, whose upper edge or freely upwardly facing surfaces mainly are level to the surface of the horizontal top part 3 of the fill. Surrounding the predrilling template 7 there is shown a special reinforcement or a supporting part of the surface 9 which serves to pick up the load of platform 6, when this is placed on the foundation. The supporting layer 9, may for instance be created by injection of grout into a suitable grade of chippings which compromises the top layer 3 of the field 2. The predrilling template 7 should be placed before the completion of the supporting layer 9. The predrilling template 7 is suitably a concrete structure, generally in the shape of a concrete template with an upwardly facing cavity which will be described in more detail later, especially with reference to FIG. 3. The predrilling template 7 is constructed on shore and submerged onto the top of the fill 2 by means of suitable buoyancy cells and assistance of for instance a crane barge. A very stable anchorage for the predrilling template is achieved by grouting the area around and underneath the predrilling template. The exact levelling of the predrilling template is made by varying the pressure in the injected grout.

In FIG. 3 the predrilling template is shown from above, where the group of cells 13 comprising an essential part of platforms lower part, are indicated with broken lines. The predrilling template 7 in FIG. 3 has a mainly square outline, but two of the corners are obliquely truncated. The upwardly facing surface 24 on the predrilling template is arranged to cooperate with the corresponding surface underneath the base of the platform 6. In the surface 24 two recessed cavities *7a* and *7b* are shown being located in correspondence with two of the shafts on the platform 6. In this way the cavity *7a* in FIG. 3 is arranged to cooperate with the shaft 11 as shown on FIG. 2. Advantagely a plate shaped drilling template arranged to be used for drilling of wells in predetermined positions, may be placed on the floor of the two cavities *7a* and *7b* within each of the cavities. Said positions are indicated on FIG. 3. Regarding the dimensions, one realizes that these cavities have a considerable diameter, for instance 20 m, to give necessary room for a certain number of wellheads and for carrying out the necessary operations. The preliminary drilling before placing the platform 6, is carried out by means of a jackup platform or a semi submersible platform. The predrilling templates of the design described above will fully protect the wellheads when later on the platform 6 is submerged and installed.

At this point it should be made clear that platform 6 shown in FIG. 2, is in a hovering position somewhat above the foundation with the supporting part 9 and the predrilling template 7. The platform is shown in this position to illustrate more clearly certain details of the base of the platform in relation to the structures on top of the foundation 2.

The shaft 11 has a throughgoing opening 26 at its base approximately corresponding to the span of the cavity *7a*, suitable a circular opening as shown in FIG. 3.

Underneath the base of the platform 6 there is shown a steel skirt 10 which may be of any known design. Other and more essential details in this connenction are illustrated in FIG. 3A, 3AD, 3B and 3C.

Each of the wells 8 of the predrilling template 7 is connected to a conductor pipe 30, as especially indicated in FIG. 3A and 3AD. As the cavity *7a* in the predrilling template are going to be emptied after installation of the platform 6, it is necessary to provide complete sealing at all points around the predrilling template. The sealing around each of the conductor pipes 30 in the floor of the predrilling template 7 can be carried out by means of two-step sealing devices 31 as shown enlarged in FIG. 3AD. These sealing devices 31 may be of any structure known in the art.

The sealing between the base of the platform 6 and the upper part of the predrilling template 7 is shown in detail in FIG. 3B. In this figure the lower part of the shaft 11 with opening 26 and downwardly facing surface 25 is shown touching the upwardly facing surface 24 on the predrilling template 7 more or less tightly. The cavity 7A is in this figure shown directly underneath the opening 26 in the shaft 11 as explained in connection with FIG. 2. To achieve the necessary sealing against the water pressure outside, cooperating sealing devices 27, 28 and 29 are shown providing this sealing effect. In this way sealing can be provided for by sealing elements 29 between securing- or anchorage parts 27 and 28 embodied in the predrilling template and in the walls of the shaft 11, respectively. Advantagely this sealing should be made adjustable.

From what is described above, one will realise that accurately guiding or positioning of the platform 6 in relation to the foundation and especially to the predrilling template 7, is necessary. This steering can be provided for by means of dowels which are able to penetrate the seabed beneath the platform. Two such guiding pins are indicated in FIG. 2, and in FIG. 3 corresponding guiding holes 21 and 22 is shown located either centrally on the predrilling template 7 and, respectively, in the vicinity of the opposite side of the platform. Said guiding device is shown enlarged in detail in FIG. 3C, where a dowel 23 from the base of the platform 6 is equipped a steel manted with a diameter corresponding to the diameter of a pipe which is lowered into the guiding hole 22. This guide pipe is for instance anchored to the supporting part of the top layer 3 of the fill 2 by injection of grout, as indicated in FIG. 2.

When the platform 6 with said sealing devices is correctly placed above the predrilling template 7 by means of said dowels, water in the lower part of the shaft 11 and in the cavity *7a* can be pumped out, in this way making it possible to carry out operations under atmospheric pressure and dry conditions inside the shaft, respectively, the predrilling template 7. This arrangement provides new and appreciable possibilities of carrying operations at large depths of water without having to rely on complicated, risky and expensive diver operations.

Through the groups of cells 13, which may be of any known construction, in addition to said shaft 11, there is also located a shaft 12 and two other shafts behind these (not shown in FIG. 2). An additional shaft may in similarity to the shaft 11 be arranged for cooperation with the predrilling template 7, namely above the cavity *7b*. It is evident that such a predrilling template may have one or several cavities which is arranged to cooperate with one or several platform shafts.

The shaft supports a deck 15 which in the usual way is arranged to support different components and equipments, of which some of them are shown on FIG. 2. An important feature of the basic concept according to this invention relates to a drilling module 16, a production module 17 and if desired a living quarter module 18, said modules being constructed as separate units intended to be lifted on board the platform deck 15 by means of a cranebarge, and these units are if necessary, and in any case by the end of production, able to be removed from the deck 15 in the same way before the removal of the platform 6 itself, as described earlier. For instance the size of these modules may be adjusted to make the maximum weight of each of the units around 10,000 tons. In this connection the use of light constructional materials, such as aluminium, would be obvious for instance in the living quarter unit.

The three modules are suitably placed at a certain distance from each other, for instance 5 m, to provide among other things a better safety margin and an optimal form of installation and hookup in addition to a good flexibility of the arrangement. Both the living quarter module and drilling module maybe formed as standard units, whereas the process or the production unit will have to be adapted to the reservoir characteristics and the production capacity of the field. For the purpose of lifting these modules on and off the deck 15 offshore by means of cranebarges, the modules are suitably provided with permanent lifting ears (not shown) in the frame structures of these modules.

If building or changing the production or process units 17 is necessary due to changed or new well characteristics, this can be carried out when moving to a new location and during the time needed for establishing a foundation and predrilling on the new location.

A platform as described above, especially in regard to FIG. 1 and 2 and possibly provided with further devices and equipment which will be explained in the following, can of course also be employed in fields or locations where a larger fill 2 as illustrated on FIG. 1, is more or less unnecessary. When the water depth is suitable, such a fill may be omitted, because the basement shown in FIG. 2, may be established directly on the seabed.

By referring to FIG. 4–7, devices and equipment related to the platform deck 15, especially related to safety and transportation of personnel, hereunder evacuations in emergency, shall now be described. An important feature in this respect is that the deck 15 is constructed essentially as a continuous concrete plate 35 being very resistant against fire and which therefor can provide a very effective shield between the heat evolved by an accidental fire on the top side of the plate, where critical modules and equipments are located, and below the deck, which area is suitably equipped with rescue and evacuation equipment. The concrete plate 35 is according to the usual practice of construction supported by main beams 36 in one direction and perpendicular secondary beams 37 resting on the top part of the four shafts 11, 12 and 111 and 112 (look at FIG. 7). This construction provides a very stable and resistant deck surface 15, where equipment for personnel transport and emergency- and rescue equipment, especially equipment for evacuation, advantageously is placed underneath the concrete plate 35. Necessary access from the deck 15 to the area underneath the deck may suitably be provided for by means of staircases as shown at 40*a*, 40*b* and 40*c* located at the edges of the deck. In the case of a fire and/or explosion, evacuation can in this way be achieved very rapidly from different points from the deck down these stairs to a shielded location below the concrete plate 35. If necessary and advisable throughgoing holes or shafts with staircases down through the deck and the concrete plate 35 inside the deck area itself, for instance directly from and inside the living quarter module 18, can of course be made in addition to the before mentioned stairs. In addition to said stairs slides known in the art may be mounted for the fastest possible evacuation from the same locations.

For transport and evacuation of personnel a transport bridge or gangway 42, is shown in FIG. 4 as indicated with noninterrupted lines in a horizontal standby position below the deck 15. This transport bridge 42 can be lowered to an inclined position as shown with broken lines from a swivel point 48 at the one end, whereby the opposite lower end is made to reach a suitable height above the water surface 5 to make contact with a vessel 50 indicated with dotted lines in FIG. 7. The transport bridge 42 is made of two telescopically operating parts 42*a* and 42*b*, where part 42*b* is shown in an extended and inclined position in FIG. 4, the part 42 likewise being indicated by broken lines FIG. 7. This construction will provide a safe and comfortable gangway for personnel both when used for regular transport to and from the platform as well in an emergency situation where evacuation is necessary. The transport bridge 42 may have a form of a gangway with steps and/or a slide may be mounted making an even faster evacuation possible. At the lower and outer end of the telescope part 42*b* there is in FIG. 4 and 7 shown a flexible extension 42*c* making it easier to establish contact with the vessel 50 in FIG. 7. The lowering of the transport bridge 42 from horizontal position to the inclined operating position may for instance be carried out by means of a winch with wire 44.

As is most clearly shown in FIG. 5, arrangements can also be made for another transport bridge or slide 43 which in similar to the transport bridge 42, may be lowered from an approximately horizontal position (broken lines) up under the deck 15, to an inclined position 43*a* in an outwardly/downwardly inclined direction from the platform. The transport bridge 43 maybe lowered by means of a bearing 49 and winches 47*a* and 47*b* with wires 46*a* and 46*b*, respectively. The transport 43 is provided with a guide rail 45 arranged to steer lifeboats 41 from a stationary position under the deck or the concrete plate 35 by a gliding movement down to the water surface 5, whereby the last part of the launching happens by free fall from the lower end of the transport bridge 43, whereby the lifeboats there from will have a horizontal velocity component to provide a movement in the preferred direction away from the platform during evacuation.

FIG. 4 to 7 also shows a conventional flareboom 19 with supporting bracket 19*a* on the deck 15 suitably designated as an integrated part of the concrete plate 35 and assosiated parts of the beams 36 and 37. In accordance to common practise such a flareboom is located on the opposite side of the deck 15 relative to the living quarter module 18 as indicated in FIG. 2. Correspondingly the above mentioned transport bridges 42 and 43 is arranged to have its outer or lower endpoints located in the largest possible distance from the opposite and risky side of the platform where among other units the flareboom 19 is mounted.

I claim:

1. An offshore drilling system comprising:

(a) a substantially flat drilling template having a well hole therein for drilling a well therethrough and a guide hole therein for aligning a gravity platform over said well hole; said template fixed to a surface that defines the bottom of the water, said template being below water level;

(b) said gravity platform comprising:

(i) a deck positioned above water level;

(ii) a base of cells positioned below water level;

(iii) a guide pin attached to said base for fitting into said guide hole; and (iv) a substantially vertical shaft connected at one end to said deck and at the other end to said base, said shaft having a vertical through hole, said vertical through hole having an opening at said other end that mates with said well hole in said template such that said well hole communicates through said vertical through hole to said deck.

2. The system of claim 1 further comprising a support layer positioned between said template and said surface that defines the bottom of the water, said support layer fixed to said surface that defines the bottom of the water and said template fixed to said support layer.

3. The system of claim 1 wherein said surface that defines the bottom of the water is the sea bed.

4. The system of claim 1 wherein a fill pile has been deposited on the sea bed, said fill pile having a substantially flat top, and said surfaces that defines the bottom of the water is said substantially flat top of said fill pile.

5. The system of claim 1 further comprising a means for clamping said other end of said shaft to said template to form a seal between said shaft and said template.

6. The system of claim 1 further comprising a pipe that extends from inside said well, through said well hole in said template and into said vertical through hole of said shaft.

7. The system of claim 1 wherein said deck comprises a substantially continuous concrete plate and supporting beams; said deck having a drilling module, a production module and a living quarters module located above said deck; and said deck having transportation equipment for personnel, emergency equipment and safety equipment located below said deck.

8. The system of claim 1 wherein said deck has at least one transportation bridge positioned below said deck, one end of said transportation bridge hinged to said platform, the other end of said transportation bridge movable to a point above the water level.

9. The system of claim 2 wherein said template has a top and said support layer has a top and said top of said template is level with said top of said support layer.

10. The system of claim 4 wherein a vertical distance measured from said substantially flat top of said fill pile to the water level is between about 20 to 400 meters.

11. The system of claim 4 wherein said fill pile comprises rock and rock chips.

12. The system of claim 4 wherein said fill pile has sloping sides with a gradient of about 1:3.

13. The system of claim 6 further comprising a means for forming a seal between said pipe and said template.

14. The system of claim 7 wherein a passageway to said transportation equipment for personnel, emergency equipment and safety equipment is located along the sides of said deck.

15. The system of claim 7 wherein said production module, said drilling module and said living quarters module are detachable from said deck.

16. The system of claim 8 wherein at least one of said transportation bridges is a monorail on which lifeboats are movably hung.

17. The system of claim 8 wherein at least one of said transportation bridges is a gangway for personnel, said gangway having a telescopically movable outer part and a flexible extension part for transport of personnel to a vessel.

18. The system of claim 10 wherein said vertical distance is about 150 meters.

* * * * *